US007819484B2

(12) United States Patent
Conforti

(10) Patent No.: US 7,819,484 B2
(45) Date of Patent: Oct. 26, 2010

(54) SEAT PAD

(76) Inventor: Carl J Conforti, P.O. Box 6315, Fall River, MA (US) 02724

( * ) Notice: Subject to any disclaimer, the term of this patent is extended or adjusted under 35 U.S.C. 154(b) by 0 days.

(21) Appl. No.: 12/381,383

(22) Filed: Mar. 11, 2009

(65) Prior Publication Data

US 2009/0218861 A1 Sep. 3, 2009

(51) Int. Cl.
*A47C 7/02* (2006.01)

(52) U.S. Cl. ..... 297/452.21; 297/219.1

(58) Field of Classification Search ..... 297/219.1, 297/452.21, 452.26
See application file for complete search history.

(56) References Cited

U.S. PATENT DOCUMENTS 3,220,767 A * 11/1965 Hendrickson ..... 297/228.12
4,768,245 A * 9/1988 Dutton ..... 5/636
5,809,595 A * 9/1998 Stevens et al. ..... 5/653
5,864,903 A * 2/1999 Newman ..... 5/639
6,647,570 B1 * 11/2003 Ong ..... 5/485
6,820,852 B2 * 11/2004 Wainscott et al. ..... 248/444.1

* cited by examiner

*Primary Examiner*—Joseph Edell

(57) ABSTRACT

An improved seat pad and integrated gripping member is provided, which prevents the pad from slipping when placed between a seating surface and individual. The gripping member is permanently attached to the seat pad along its edge and covers a portion of either side of the seating surface. The gripping member is reversible therefore either side of the seat pad may be selectively exposed during use. This allows both seat pad sides to be constructed of different materials, colors, or patterns and be interchangeable when desired by the user.

8 Claims, 10 Drawing Sheets

SEAT PAD

CROSS REFERENCED AND RELATED ACTIONS

This application claims the benefits of U.S. patent application Ser. No. 11/265,007 filed Nov. 5, 2007, now filed as a continuation on Mar. 11, 2009.

FIELD OF THE INVENTION

The invention pertains to seat pads, and more particularly to seat pad assemblies that are constructed of a cushion, a non slip member and providing a multi functional, decorative, protective cover assembly for an individual to sit comfortably and securely on an adjoining surface or structure.

BACKGROUND OF THE INVENTION

Many pads exist in the market today that have various shapes, sizes and fashion designs. Seat pads are sold in the market constructed mostly of a fabric like material, and it is not uncommon to find these materials made of synthetic, natural fibers or other man made materials. Filler materials such as foam or other like materials are used to create cushioning comfort in the pad. Pads are typically constructed to provide the same cushioning comfort when the pad is rotated from one side to the other. Chair pads, seat pads, decorative pillows and cushions (hereafter "pads") are examples of articles that may be placed over a smooth surface and are intended to remain in a stationary position during use. Pads are manufactured for use in boating, vehicles and as home furnishings. These items are typically fastened to chairs, boats and the interior of vehicles using various with the gripping component or surface between the smooth surface (e.g. chair seat) and the bottom facing pad surface. The gripping component or surfaces may be provided as separate items or fixedly attached to one side of the pad or cushion. Gripping surfaces can be provided as separate components that are glued or stuck to the pad or seating surface. These types of non-attached gripping surfaces could become a safety hazard due to the likelihood of separation from the pad. Other pads on the market today provide a removable cover with a one sided fabric layer, a foam insert, and a rubber mesh layer fixed by a bias on the opposite side of the fabric, functional only on one side to prevent slipping. Products can be found in the automotive or consumer products market, where a rubberized material is used to stop slippage of a small child's car seat, or booster. These designs folded with a fabric backing may be reversible but not stable without additional fasteners or fixtures to prevent shifting or rotating movement when weight is applied. Some pads provide one sided gripping surfaces and others provide two sided decorative patterns. It has been noted that there are seat covers in the market, more specifically in the automotive market, that have a seat back, fabric like decorative design and second component, a lower seating portion of rubberized material. The seat cover can be folded at a mid plane to provide a means to overlay the fabric portion, but the overlay of two layers do not provide a means to resist slippage between the two layers, and are often big and bulky to store and to handle. Some pads found constructed of polyvinyl chloride material may offer some slip resistance, but not always adequate in gripping mating surfaces, limiting in material selection. The U.S. Pat. Nos. 6,212,717 and 5,896,603 disclose chair cushions and place mats formed of a top fabric panel attached to a bottom panel that has a high coefficient of friction. The bottom panel is preferably a rubberized web material with an open or mesh pattern. The rubberized material prevents the chair cushion or place mat from sliding over smooth surfaces. U.S. Pat. No. 4,457,032 discloses a cushion having a lower layer that also has a high coefficient of friction. U.S. Pat. No. 5,429,852 shows another chair pad or cushion also having a lower panel with a high coefficient of friction. The U.S. Design Pat. No. 360,794 illustrates a combined child cushion and rubber grip pad unit. A disadvantage of the above chair cushions with permanently attached gripping surfaces is that only one side of the cushion can be exposed during use. If the exposed side becomes irreparably damaged or stained, then it may require replacement because the cushion cannot be reversed. Published patent application No. 20050146177, dated 7 Jul. 2005, to Peter Jerome, discloses a seat cushion with an integral gripping member that prevents the cushion from sliding during use. The gripping member attaches to the cushion by a connecting strap which allows the gripping member to be selectively placed in contact with either panel of the cushion. The gripping member is detachable and is not formed as a reversible permanently attached part of the cushion. If the gripping member was permanently attached the chair pad would be somewhat bulky and cumbersome to handle, and it also should be noted the seat pad and gripping member may not provide sufficient gripping support if twisting or torque is applied to the seating surface, having only one side or panel attached to the gripping member. A disadvantage of the above seat cushion is the seat pad and gripping surface are not fixedly attached to prevent movement between the pad and seating surface and is not an economical means to fabricate the seat pad.

SUMMARY OF THE INVENTION

In accordance with the present invention, an integrated seat pad assembly is provided. The assembly includes an affixed gripping member that forms a pocket and that prevents the pad from sliding during use. The gripping member is secured along its edge to the seat pad forming a pocket thereon. The gripping member is rotatably reversible to be placed in contact with either side of the seat pad contact surface allowing for alternative sides of the seat pad to be selectively chosen, thereby exposing alternative sides for cleanliness, different materials or fashion designs.

The seat pad construction ensures that movement is substantially eliminated between the gripping member and seating surface when the seat pad is applied to the seating surface. The pad offers an improved, secure, means providing a non slip seating surface without the use of strings, ties or other fastening means. The construction of the multi-use pad is manufactured at a low cost minimizing the expense of materials, separate fasteners and/or attaching mechanisms.

The pad gripping component is resiliently reversible, and fixedly attached to at least a portion of the outer perimeter of the pad assembly and preferably at least two sides or points within the midsection of the gusseted edge of the seat pad assembly. The pad gripping component may also be fixedly attached to at least a portion of three sides of the approximate midsection of the gusseted edge in a square or rectangular shape body. The gripping component securely fastened to a portion of the outer perimeter of the seat pad forms a pocket at the upper or lower panel of the seat pad assembly offering an added feature of a convenient storage. For cost savings in manufacturing, the seat pad uses only a portion of the gripping component anti-slip material as compared to the prior art. The pad gripping component can be selectively placed to secure the seat pad from movement, at minimum approximately one quarter to one half of the surface pad area that contacts the seating surface or structure.

In another embodiment of the invention the pad can be made of fabric, plastics or like materials. The pad may include foam, natural fibers, or other like filler materials. The pad may contain a foam or like filler material with a series of holes for air cushioning thereby reducing the amount of foam material used. In some cases the reduction of filler material may be up to more than fifty percent. A thin sheet of resilient film like material can be adhered or laminated to at least one side of the perforated foam or like filler material, providing a different cushion comfort when the chair pad is rotated one side to the other, providing a firm to soft feel. Yet another embodiment of the invention, a seat pad assembly includes an inflatable bladder assembly to vary the height of the seat pad to accommodate different users. The inflatable bladder may consist of a semi-rigid sheet of plastic material, a spring like member and airtight sealed bladder or bag with a valve to allow air into the bladder, providing various heights with desired volume of air entering the bladder, or various adjustments in comfort level as desired by the consumer. The spring member may also assist in improving the rate of filling the bladder with air, where the valve is open to accommodate variations in desired height.

It is therefore an object of the present invention to provide a seat pad with an integrated anti-slip material permanently affixed thereto, the anti-slip material covering a portion of a side of the pad, the seat pad adaptable in shape and size to accommodate various dimensioned seating surfaces.

It is a further object to provide a seat pad that is portable, economical to manufacture, the seat pad having an anti-slip material that is reversible to either side of the pad, the reversible anti-slip material allowing exposure of either side of the seat pad with a functional gripping feature.

It is still a further object of the present invention to provide a seat pad with a convenient storage pouch, the storage pouch formed from the reversible anti-slip material construction.

It is a further object of the present invention to provide a seat pad having different cushioning comfort levels, the levels of cushioning selectable by rotating the seat pad into a different position.

It is still a further object of the present invention to provide a seat pad having an anti-slip material that is coupled with a cache of stacked disposable liners to maintain cleanliness of the seat pad surface; they may include decorative designs or like materials.

It is a further object of the present invention to provide a portable seat pad having an anti-slip material that can be rotatably reversible to either the front or bottom surface of the pad and also provide a thermally insulated component within the pad to retain heat loss between the body and seating surface.

The present invention is not however limited hereto. Numerous other advantages and features of the present invention will become readily apparent from the following detailed description of the inventions and the embodiments thereof, from the claims and from the accompanying drawings in which the details of the invention are disclosed as part of this specification.

BRIEF DESCRIPTION OF THE DRAWINGS

These and other advantages of the invention along with the invention itself will be fully understood after review of the following figures, detailed description and drawings.

DETAILED DESCRIPTION

Figure 1:
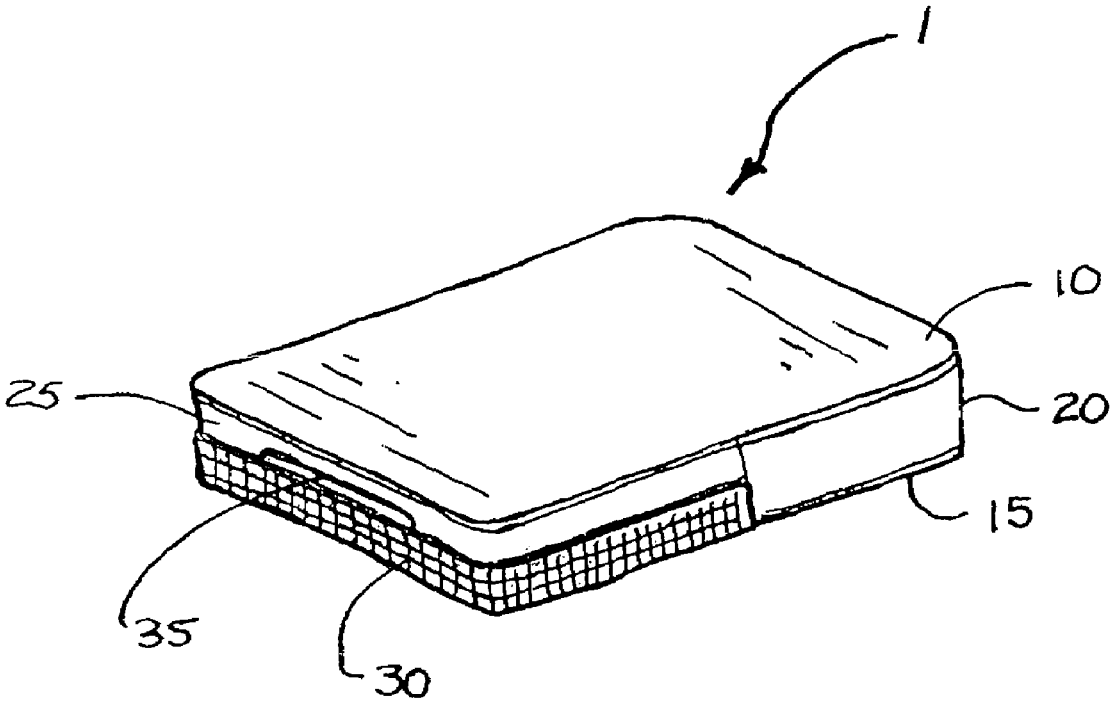
FIG. 1 is a perspective top view of one embodiment of the seat pad assembly.

While the invention described is susceptible of embodiment in many different forms, they are shown in the drawing, specification and herein described in the detailed specific embodiments and is not intended to be limited to the specific embodiments illustrated. Referring to FIG. 1 the seat pad 1 of the present invention is constructed of a first upper panel 10, and a second lower panel 15 comprising a semi-rigid or resilient fabric like material. The first upper panel 10, and second lower panel 15 may provide different materials, colors, textures or a design that may be provided by other conventional methods. A third side panel component 20 is provided between the first upper panel 10, and second lower panel 15 to be attached at least a portion of the outer perimeter of upper panel 10, and lower panel 15. The third side panel 20 may be fixedly attached to the upper panel 10, and lower panel 15, to at least a portion of the outer periphery to form a three dimensional shape. An optional alternative fourth side panel component 25, may be fixedly attached to the third side panel 20, and separatively divided about the midsection and having the top outer edge fixedly attached to the edge of the first upper panel 10, and the lower opposing edge attached to the edge of the second lower panel 15, and to receive a third anti-slip gripping component 30 fixedly attached around the midsection of the third or fourth said side panel component 20, and 25 of the said seat pad assembly. A filler opening 35 located between the upper panel 10, and lower panel 15, to load and unload the seat pad 1, with filler material. The filler opening 35 may be secured by a mechanical fastening means for loading and unloading the filler material or otherwise permanently fastened. The seat pad 1 can be constructed in various shapes and sizes to accommodate a stool, chair, or bench type seat. The seat pad 1, material can be made from fabric like materials such as woven, non-woven, flax, wool, cotton, polycotton, vinyl, polyvinyl chloride, nylon olefins, rubber and other synthetic and non-synthetic materials or combination thereof. The seat pad 1, and anti-slip component 30 securely fastened between the upper panel 10, and lower panel 15 with the ability to pivotably rotate about the midsection and upper panel 10, and opposing lower panel 15 with a secure rotatable, reversible means. However it is understood that panels may be combined or may vary in size, shape and length to accommodate various designs and manufacturing methods without deviating from the scope of the invention.

Figure 2:
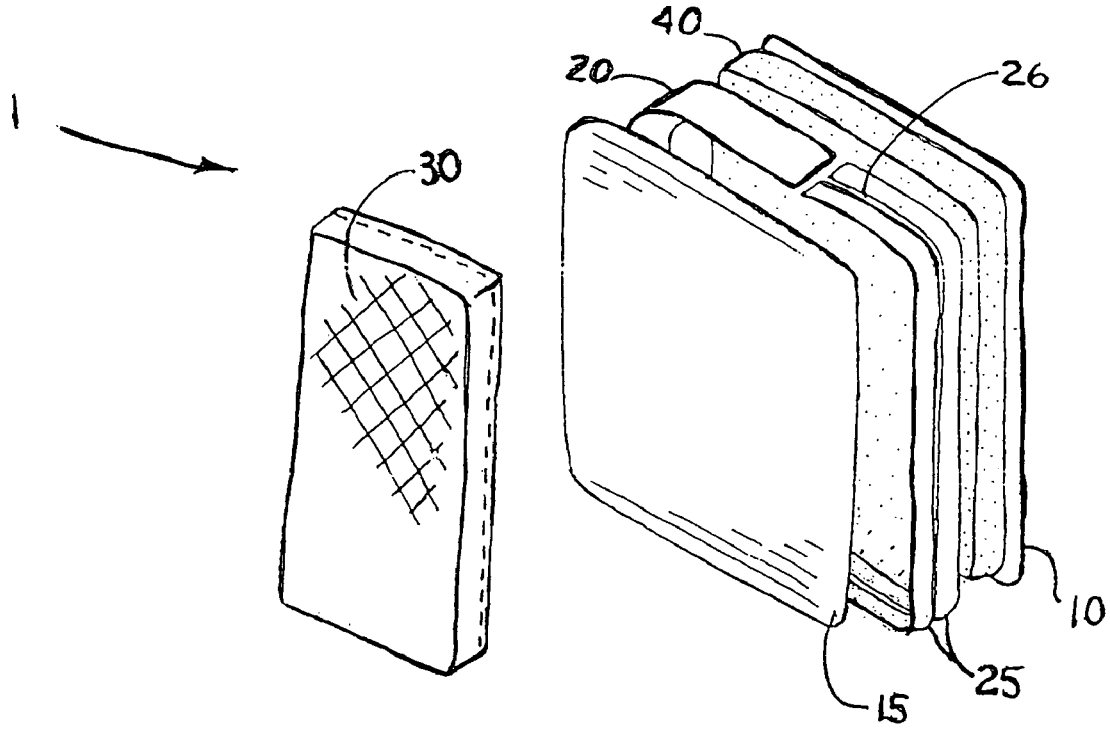
FIG. 2 is a perspective exploded view of the seat pad assembly in FIG. 1 showing the construction and anti-slip material.

Referring to FIG. 2, the seat pad 1, shown in perspective exploded view, in one embodiment having an upper panel 10, and a lower panel 15 fixedly connected by a third side panel component 20, and an optional fourth side panel component 25, split somewhere about the midsection 26 to attach an anti-slip gripping component 30 having the ability to be reversible and rotatable about the width of the seat pad 1. The fourth side panel 25 may be eliminated to reduce cost in the assembly by using the third side panel 20 to securely attach the upper panel 10, and lower panel 15 having the anti-slip gripping component 30 fixedly attached somewhere about the midsection of the width of the said third side panel 20. A filler material 40, made of synthetic or non synthetic materials not limited to but including, recycled paper, polyurethane foam, polyester fiber, tempurpedic foam (heat sensitive foam) or a combination of polyurethane and tempurpedic foam (heat sensitive foam).

The seat pad 1, assembly can be constructed by stitching, mechanical fastening, radio frequency or heat welding. The seat pad 1, upper panel 10, and lower panel 15, may comprise of a non woven backing material, reflective foil material, to add functional material properties and benefits to the seat cushion, reducing the effect of radiant heat, enabling the user to stay cool, or retain heat inside their body when sitting on the pad in adverse temperature conditions. Aluminum reflective foil reflects radiant heat and therefore minimizes the temperature effects on the pad. In addition to stabilizing internal temperatures of the seat pad, the reflective foil radiates heat back to the human body to minimize heat loss when in use. Other common materials can be used to fill the volumetric three-dimensional structure. Alternative phase change materials may be utilized as a filler material to stabilize the temperature of the seat pad and minimize adverse effects of various temperature conditions.

Figure 3A:
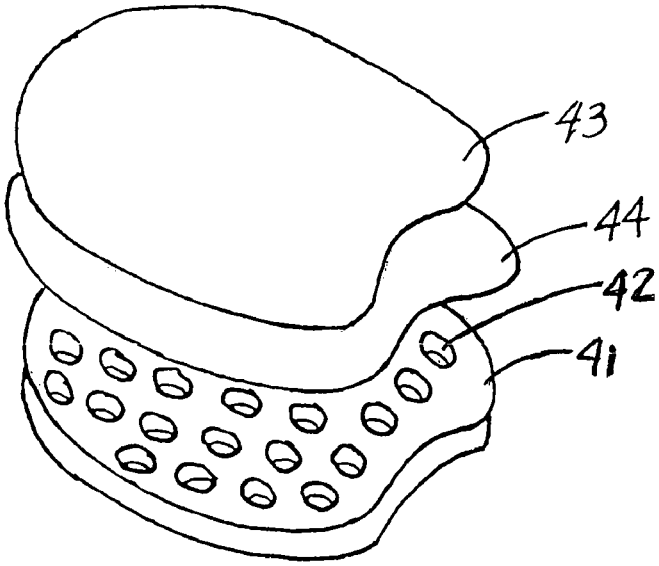
FIG. 3*a* is an exploded assembly view of the inner components of another embodiment including a cushion, resilient thin sheet and adhesive bond material.

Referring to FIG. 3*a*, another variation of a cushioned filler material 41 is shown with a series of thru-holes 42 passing through the body of the cushioned filler material 41 that provide a means to reduce the filler material's volume of material and provide a desired firmness when a thin airtight member 43 made of film or fabric like material and affixed by adhesive 44 to trap air in the holes 42 of the cushion filler material 41 providing an enhanced cushion effect. When the seat pad assembly 1 of FIG. 1 is rotated, the opposite effect is present, where the filler material 41 offers a less dense comfortable seat pad allowing the air to evacuate from the seat pad. When utilizing the filler material 41, the seat pad 1 may be selectively rotated 180° degrees so that the holes 42 are in close proximity to an individual seated. By selectively rotating the seat pad, the user can change the firmness or cushioning effect of the seat pad cushion. A visual indicator or graphics may be applied to the seat pad to indicate firmness, or other effects when rotated to the desired position.

Figure 3B:
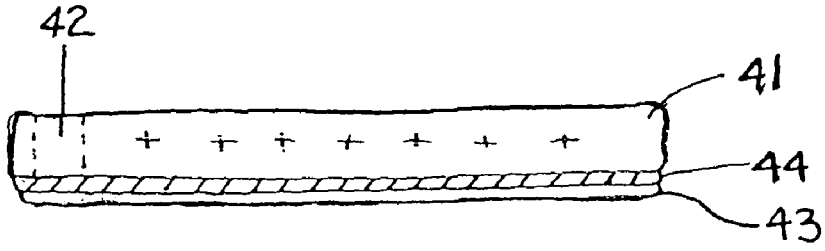
FIG. 3*b* is a side view of the assembly of FIG. 3*a* illustrating structural aspects of the present invention.

Referring to FIG. 3*b*, cushioned filler material 41, as shown in a side view with a series of holes 42 exposed upwardly away from the seating surface, where the filler material 41 is coupled to a thin member 43 with bonding adhesive 44. The effects may be variable with changes in the respective size or diameter of the holes 42, and also provide additional benefits minimizing materials for cost effective construction of seat pads.

Figure 3C:
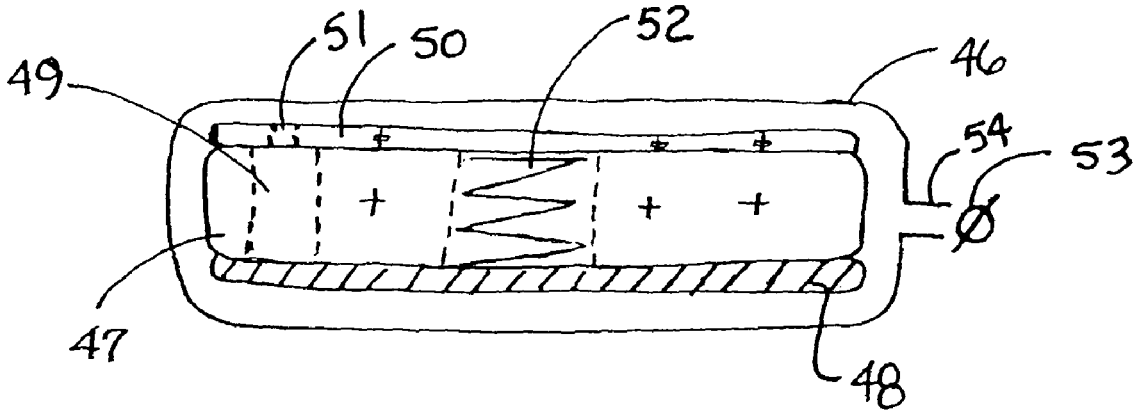
FIG. 3*c* is a side cutaway view of one embodiment of the seat pad's inflatable bladder assembly components.

Referring to FIG. 3*c*, bladder 46, containing a resilient filler material 47, including a series of holes 49, airtight semi-rigid member 50, with perforated holes 51. The bladder 46, having a valve 53, and orifice 54, that enables the bladder 46 to receive air when the valve 53 is open. The spring 52 assists the bladder 46 to increase in size to the maximum height, with maximum air capacity. The valve 53 can remain open to exhaust air from the bladder, and upon closing the valve 53, the seat pad will remain at the desired height with the bladder holding a constant volume of air.

Figure 4:
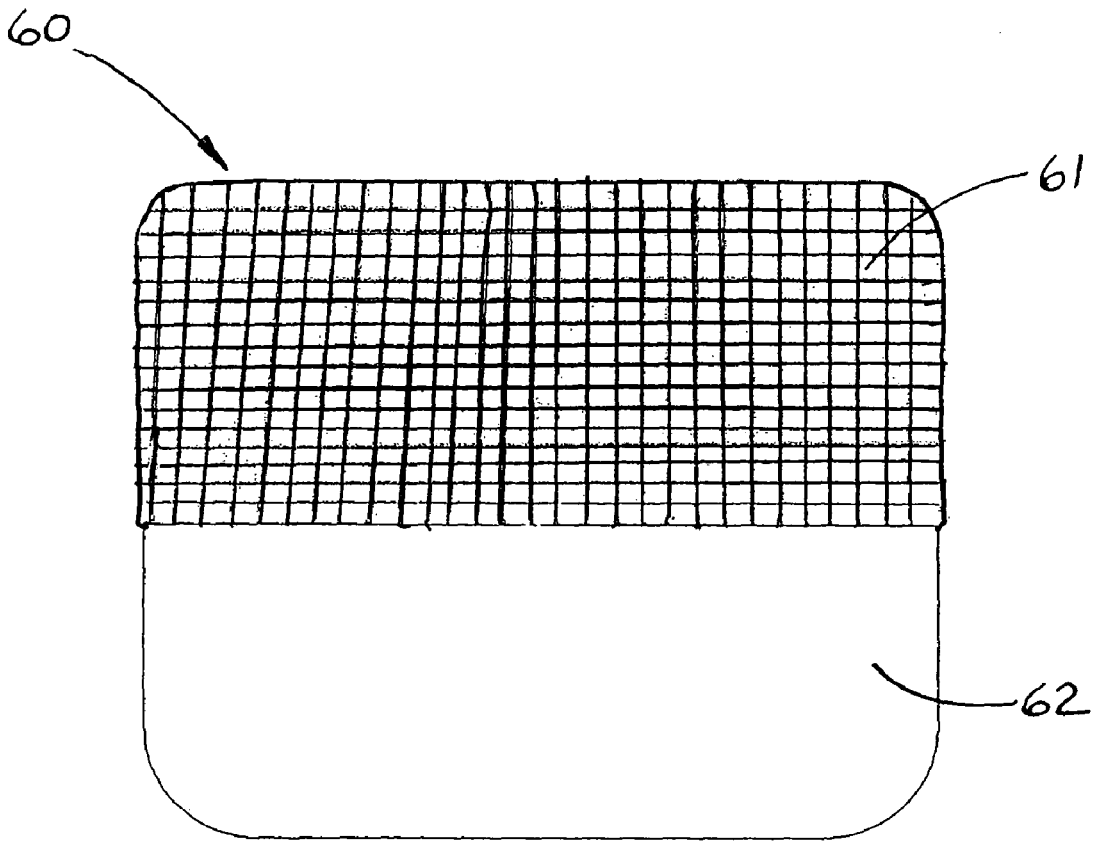
FIG. 4 is a bottom view of one embodiment of the seat pad assembly illustrating the anti-slip material.

The materials for construction may be desirable as a resilient air sealable sheet film or fabric like material. The bladder 46 may be fabricated of resilient PVC (polyvinyl chloride), polymers, thermoplastic elastomer, urethanes, polyester, or other like films. The airtight semi-rigid member 48 and semi-rigid member 50 can be fabricated from plastic, film extrusions, using radio frequency welding, heat sealing or alike. Referring to FIG. 4 seat pad shown in a bottom view, having an anti-slip material 61, closely held to the surface of the lower panel 62, covering less than sixty percent of the seating surface area minimizing the cost of materials, and providing sufficient anti-slip material surface area contact to securely position a pad on a seating surface. The pad 60 may be fabricated in various shapes and sizes.

Figure 5:
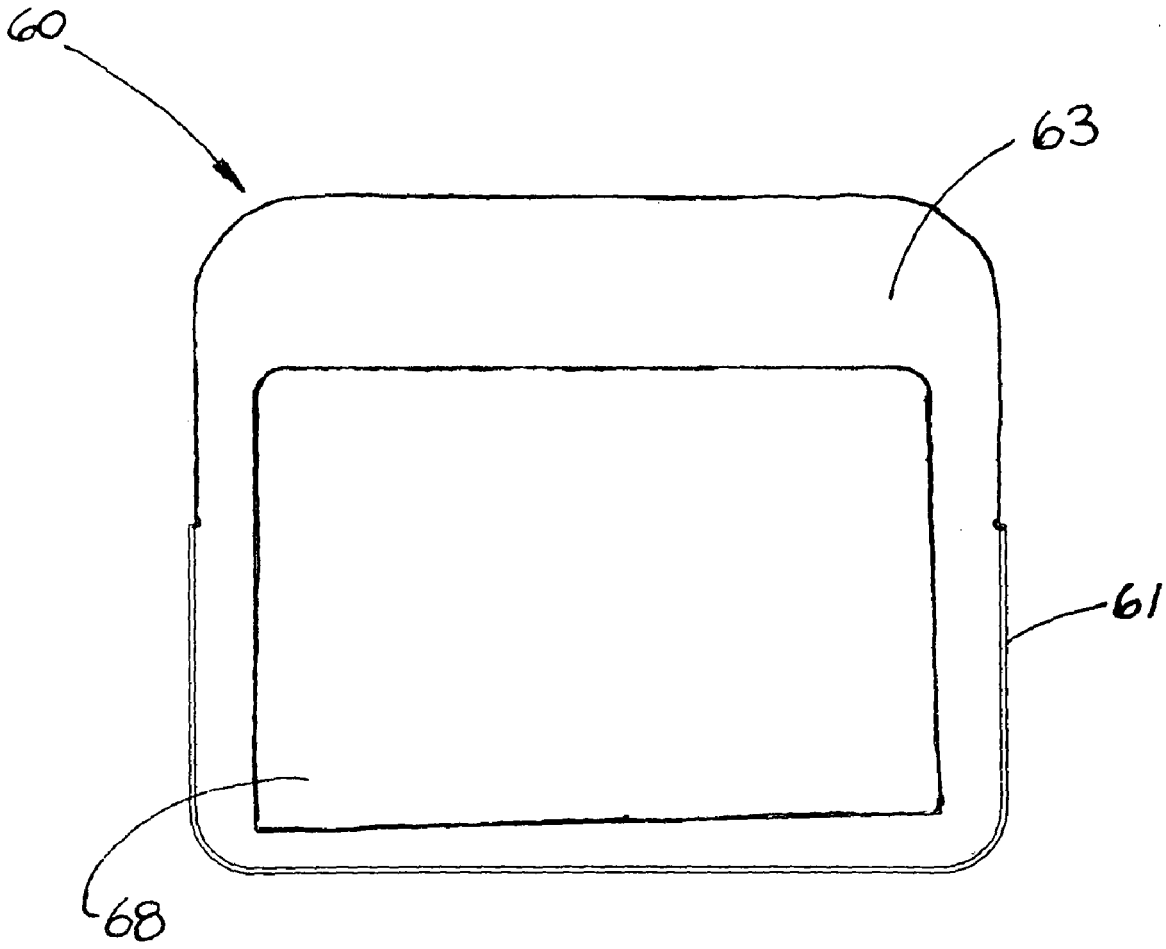
FIG. 5 is a top view of one embodiment of the seat pad assembly with optional disposable liner.
Figure 6:
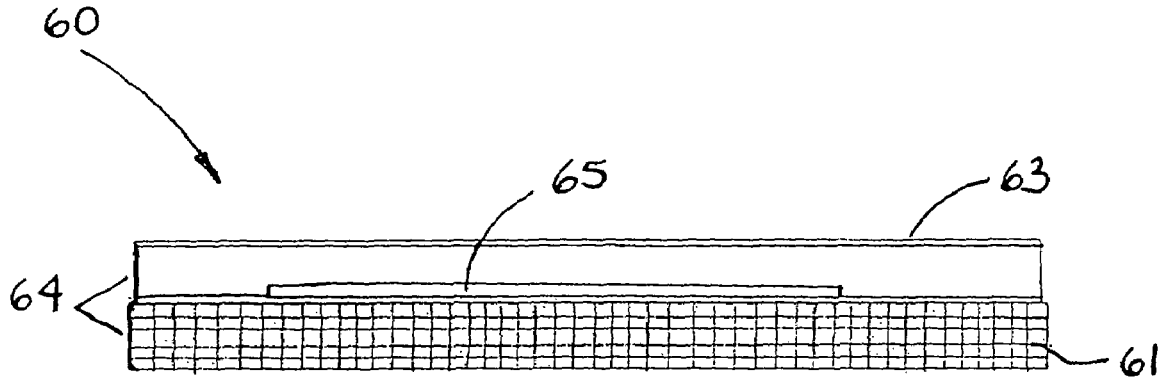
FIG. 6 is a rear end view of one embodiment of the seat pad assembly.

Referring to FIG. 5 seat pad 60, shown in a top view, having a top surface area defined by the upper panel 63, that may provide an alternative design or material than the lower panel 62, as shown in FIG. 4, is constructed with an anti-slip material 61 that partially covers the lower panel 62, and part of the side wall panels 64, as shown in FIG. 6. The seat pad 60 may comprise of various shapes, sizes and patterns to accommodate the consumer, fashion and market demands. The anti-slip material 61 preferably should be of a high coefficient of static friction, made of rubber mesh like material, latex or alike. An optional liner material 68 can be coupled to the seat pad 60 on the surface that may come in contact with the user or opposing surfaces as desired. The liner material 68 may comprise of an individual sheet or stacked layer of disposable liners.

Referring to FIG. 6 a rear side view of the seat pad 60, having an upper panel 63, gripping member 61, and side panel 64, where the side panel 64 is coupled to the gripping member 61. The gripping member 61 is fixedly attached to a portion of the outside perimeter of the seat pad 60, and may include a filler opening 65 to insert the filler material into the three dimension structure and can be permanently closed or selectively fastened by means of a zipper, thread, hook and loop, or other mechanical means. The filler opening 65 is not limited to the mentioned side panel and various configurations may require different fill methods. The methods and various configurations shall be noted but not limiting the scope of the said invention.

Figure 7:
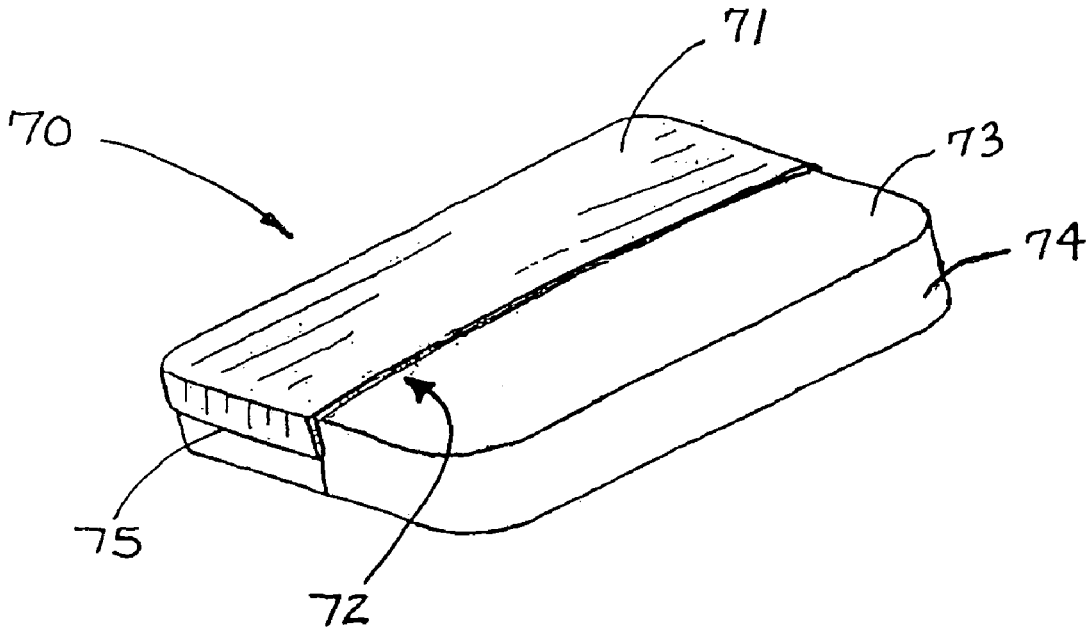
FIG. 7 is a perspective view of the seat pad assembly illustrating the pocket formed by the non-slip gripping member.

Referring to FIG. 7 another preferred embodiment of the said invention, seat pad 70 shown in a perspective top view, illustrates a non-slip member 71 fixedly attached to approximately the midsection 75 of side panel 74. The non slip member 71, defined by a portion of the shape of the seat pad 70, is fixedly attached on three sides held in close proximity to the lower panel 73 surface area, where the space between the non slip member 71, and the lower panel 73 define a pocket 72 that has the capacity to store articles within the seat pad 70 assembly. Small articles such as papers, photos, magazines and alike can be stored within the assembly and conveniently removed and inserted without the need for other storage devices. The need for a pocket or pouch is more commonly used in travel, outdoor events, or sports and alike games.

Figure 8A:
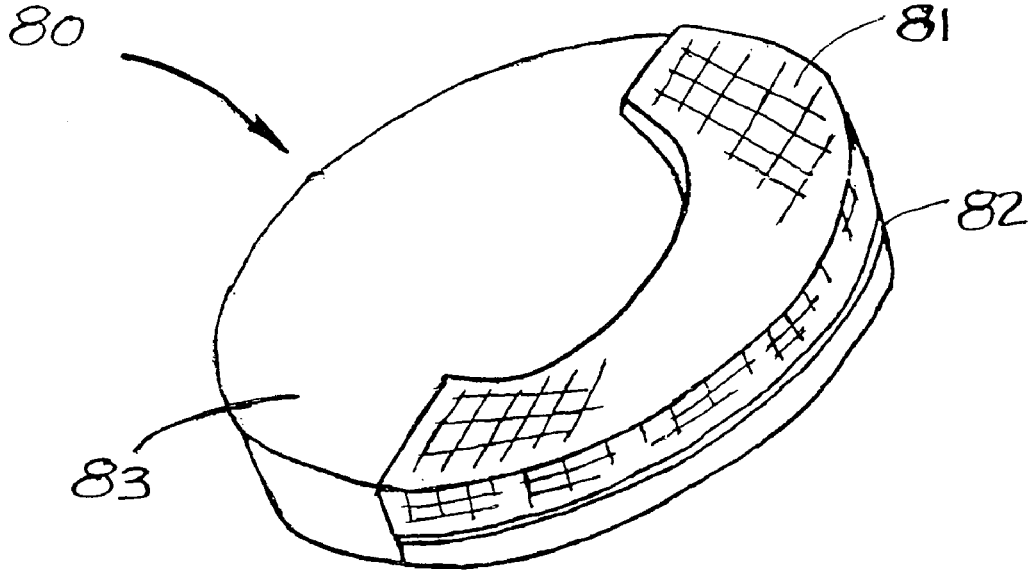
FIG. 8*a*, 8*b* are bottom perspective views of the seat pad assembly illustrating alternative structural designs of non slip gripping members.
Figure 8B:
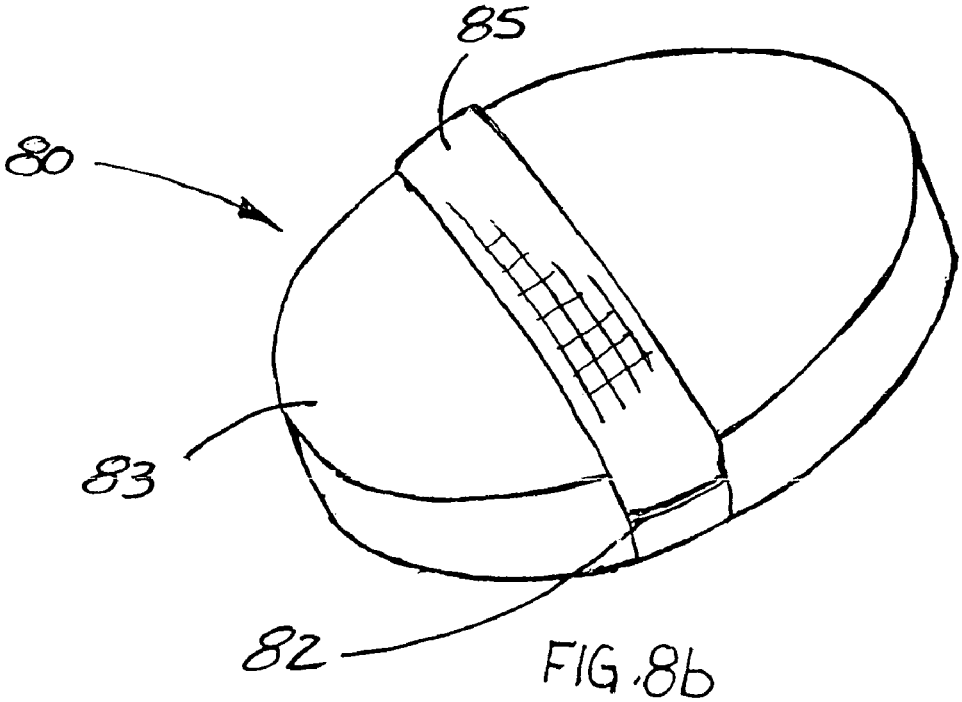
Figure 9A:
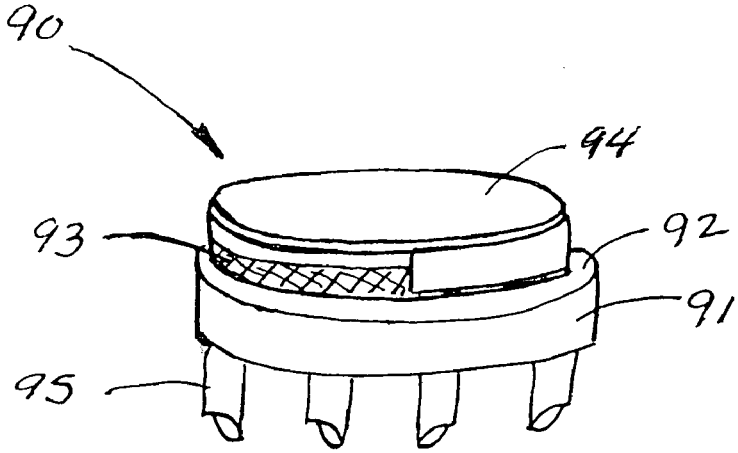
FIG. 9*a* is a perspective view of the subject invention circular dimensioned for use on a stool.

Referring to FIGS. 8*a* and 8*b* the seat pad cushion 80 is shown as an assembly, the assembly main components comprising of a lower panel 83, a gripping member 81, on FIG. 8*a*, and another embodiment shown of the gripping member 85 on FIG. 8*b*. The anti-slip material used on gripping members 81 and 85 are shown with a reduction in material weight for lowering the manufacturing cost of the seat pad 80. The gripping member 85 as shown in FIG. 8*b* can also be utilized as a handle to enable the consumer to carry the seat pad 80, or securely hold onto in the event of an emergency. The seat pad 80, and the gripping member 85, are constructed for use as one component, with a resilient means to turn or flip the gripping member 85 around the seat pad 80 for multi-use purposes. Referring to FIG. 9*a* illustrates an alternative design within the scope of the invention. As illustrated in FIG. 9*a* a perspective view of seat pad 90, in use on a stool 91, where the gripping member 93 is in contact with the stool seating surface 92 allowing the consumer to sit securely on the upper panel 94 surface area resisting movement. The stool 91, and support leg(s) 95, provide an unstable surface for chair pads and cushions. The need for a non-slip seat pad with minimum parts and no assembly is desired.

Figure 9B:
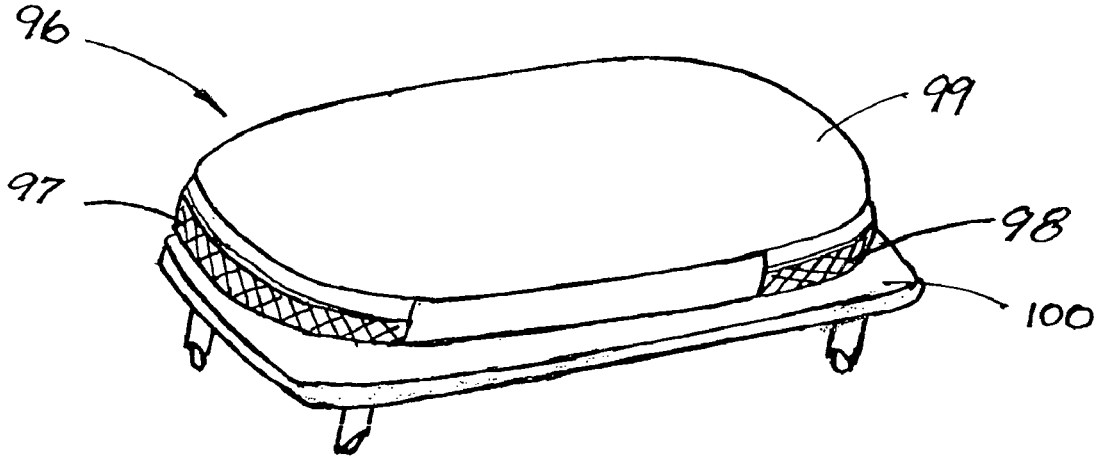
FIG. 9*b* is a perspective view of the subject invention rectangular dimensioned with an integral gripping member at either or both ends.

As illustrated in FIG. 9*b* a seat pad 96, is shown in perspective view on a bench seat 100. The bench seat 100 comes in contact with the seat pad 96, and two areas are disclosed showing the anti-slip gripping members 97 and 98, respectively. The prior descriptions and embodiments are shown within the scope of the invention for a bench seat design. The bench seat design may offer one side of the upper panel 99 being water resistant and the opposite side having a different texture or fabric design. The bench seat 100, and seat pad 96 with anti-slip gripping members 97 at one end and 98 at the other end illustrate how the description of one embodiment may be applied to another within the scope of the invention disclosed.

Figure 10:
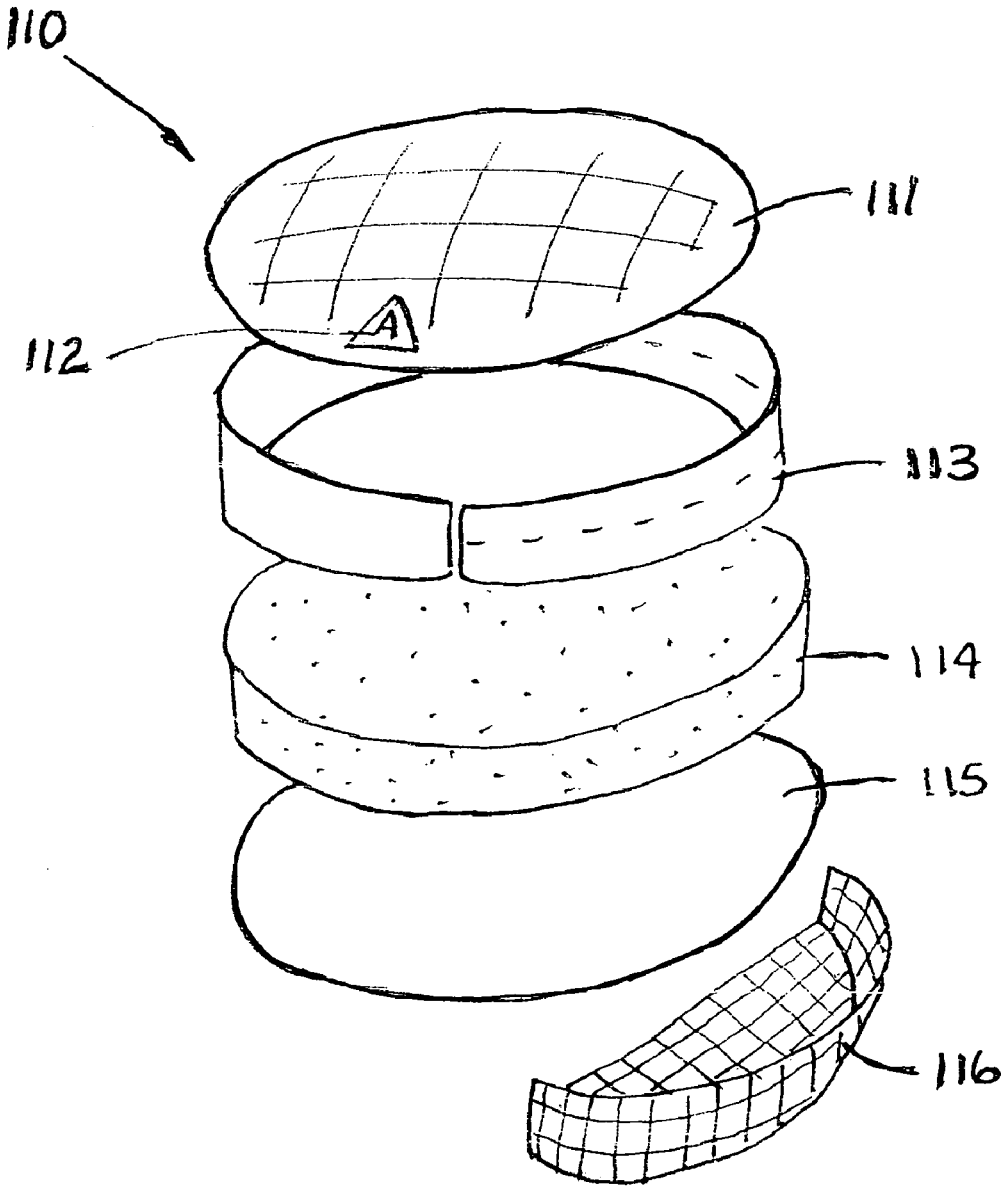
FIG. 10 is an exploded assembly view of one embodiment of the seat pad with a reflective foil component and visual indicator.

Referring to FIG. 10, an exploded assembly view of one embodiment is shown seat pad 110, having a first panel 111 comprising a reflective foil material, a second panel 113 fixedly attached to at least a portion of the said first panel 111, a third panel 115 fixedly attached to a second panel 113 or subsequent sub assembly in connection to the first said panel 111 to form a three dimensional shape. The three dimensional shape includes a filler material 114, and also may include an anti-slip gripping member 116 fixedly attached between the said first panel 111, and the said third panel 115, where the gripping member 116, is pivotably rotatable around the width of the seat pad 110, to selectively use either side of the seat pad 110 for various features. A visual indicator 112 may be used to indicate a feature or provide instructions for use or even provide temperature indicia for the consumer in various temperature environments.

It should be understood that the proceeding is merely a detailed description of one embodiment of this invention and that numerous changes to the disclosed embodiment can be made in accordance with the disclosure herein without departing from the spirit or the scope of the invention.

I claim:

1. A reversible slip-resistant pad comprising:

a cushion made of resilient material;

a flexible cover including a top panel, a bottom panel, and a side panel with the side panel being fixedly attached along the perimeter of the top panel and fixedly attached along the perimeter of the bottom panel, the cover being configured to provide an internal chamber configured to receive the cushion;

a slip-resistant panel comprising a flexible material fixedly attached to the cover and configured to contact the cover when the cushion is received by the cover and the cushion is uncompressed beyond compression induced by the cover;

wherein the perimeter of the slip-resistant panel is fixedly attached to the side panel of the cover along the mid-section of the side panel, wherein the slip-resistant panel is rotatably reversible between a first position in contact with the upper panel and a second position in contact with the lower panel, and wherein the slip-resistant panel being disposed against and overlying the top panel of the cover when in the first position to cover approximately one quarter to one half of the upper panel and the slip-resistant panel being disposed against and overlying the bottom panel of the cover when in the second position to cover approximately one quarter to one half of the lower panel thereby providing selective slip resistance to top and bottom sides of the pad.

2. The reversible slip-resistant pad as in claim 1, wherein the side panel further comprises a first side panel, a second side panel, and a third side panel, said first, second, and third side panels comprising an edge formed about a periphery of said panels, said edge attached to said perimeters of said upper and lower panels, said second and third side panels adjacent one another and forming a seam therebetween wherein an edge of the slip-resistant panel is attached along said seam.

3. The reversible slip-resistant pad as in claim 2, wherein the slip-resistant panel forms a pocket for storage between the slip-resistant panel and said upper panel when in the first position and said lower panel when in the second position.

4. The reversible slip-resistant pad as in claim 2, wherein the seam is configured with a fastener.

5. The reversible slip-resistant pad as in claim 1, wherein the upper or lower panel is configured with at least one of the following, a reflective foil material, text or graphic image.

6. The reversible slip-resistant pad as in claim 1, wherein said cushion is configured to provide different cushion comfort levels on opposing sides of said upper and lower panels.

7. The reversible slip-resistant pad as in claim 1, wherein said slip-resistant panel is made of rubberized mesh material.

8. The reversible slip-resistant pad as in claim 1, further comprising an additional slip-resistant panel attached to an end of the pad opposite to the location of the slip-resistant panel.

* * * * *